United States Patent [19]

Franklin

[11] 4,428,136

[45] Jan. 31, 1984

[54] ADJUSTABLE MULTI-BAY DISPLAY

[75] Inventor: Robert P. Franklin, Lake Hopatcong, N.J.

[73] Assignee: Trans-World Manufacturing Corporation, East Rutherford, N.J.

[21] Appl. No.: 353,488

[22] Filed: Mar. 1, 1982

[51] Int. Cl.[3] ..... G09F 7/00; A47B 57/00; A47B 47/00

[52] U.S. Cl. ..... 40/605; 40/539; 40/611; 211/175; 211/199; 248/174

[58] Field of Search ..... 40/610, 575, 488, 491, 40/539, 605, 611, 606; 46/12, 13; 211/208, 189, 199, 175, 195, 198; 248/165–167, 174; 108/111, 115

[56] References Cited

U.S. PATENT DOCUMENTS

| | | | |
|---|---|---|---|
| 3,314,551 | 4/1967 | Plastow | 211/199 |
| 3,319,801 | 5/1967 | Nordstrom | 211/199 |
| 3,464,569 | 9/1969 | Downing | 248/174 |
| 3,559,814 | 2/1971 | Downing | 211/199 |
| 4,319,688 | 3/1982 | Wahl | 40/610 |
| 4,372,086 | 2/1983 | Hanlon | 40/605 |

*Primary Examiner*—Robert P. Swiatek
*Assistant Examiner*—James Hakomaki
*Attorney, Agent, or Firm*—Ostrolenk, Faber, Gerb & Soffen

[57] ABSTRACT

A display unit for merchandise wherein a plurality of bays are created against a wall or partition. The bays are formed from a series of pairs of angularly arranged vertical panels secured to the wall and spaced from each other; the space between each pair of vertical panels constitutes a bay. The wall is provided with a subsidiary header for placards or the like. Each of the individual panels secured to the wall is provided with a header, the panel header being arranged and curved so that it appears to blend into the principal header on the wall. The plurality of bays increases the surface area available for the presentation of merchandise and provides an automatic separation or groupings of merchandise while nevertheless leaving all of the merchandise visible.

12 Claims, 7 Drawing Figures

ADJUSTABLE MULTI-BAY DISPLAY

BACKGROUND AND BRIEF DESCRIPTION OF THE INVENTION

The present invention relates to display devices and more particularly to the display of different types of merchandise in multiple adjustably positioned bays in a manner that provides an apparently integrated look, appropriate eye appeal and appropriate decorative arrangement so that the kind of clutter which frequently occurs in the display and marketing of small merchandise in self-service stores is obviated.

It has heretofore been custormary in the construction of display devices for small merchandise to provide a pegboard wall on which appropriate supports may be mounted at desired locations. Carded or otherwise mounted small items of merchandise are hung from rods supported by the pegboard wall so that they will be displayed and be available for use.

In addition, various bins and containers or receptacles may also be mounted on the pegboard for uncarded merchandise which may then be picked up by the customer and brought to a cashier for purchase.

The problem with this type of display is that once a pegboard of this type is set up against a wall, the arrangement of various types of merchandise on the various rods in a long continuous display and the placement of smaller merchandise in bins which are similarly supported on a pegboard presents a cluttered helter-skelter look which is not pleasing to the eye and hence not conducive to increased sales. Any prior attempt to section off portions of the pegboard wall in order to install partitions has interfered with the line of sight and, while separation was provided, the clutter of merchandise was compartimentalized rather than remedied.

The object of the present invention is to provide a display structure for a wall or partition wherein the extended display going the entire length of the wall is arranged so that a series of bays is provided regularly arranged and spaced as required. These bays have a modular structure which permits easy assembly and rearrangement and nevertheless presents a finished completed appearance as if it were created from scratch in the exact configuration in which it is erected.

An essential element of the present invention is that a wall structure is provided having a principal header which extends the length of the wall. To this header and the wall or pegboard surface thereof are affixed a succession of panels which are triangularly arranged, each of the panels forming one of two legs of the triangle at a preferably fixed angle, the third led being the wall, having subsidiary individual headers blending into the top header on the wall and hence into an apparently continuous or single structure.

The angularly arranged panels, forming with the back wall a triangle, may be hinged together for simplicity in shipment and storage but when erected, are set at a fixed angle by an appropriate spreader device so that the curvatures that are provided at the top or subsidiary header of each of the panels will blend in a predetermined way with the principal header in the wall in order to provide the appearance of continuity.

In addition, the seam or connection between each of the panels and back wall is covered by a mirror strip which hides the interconnection and provides a reflective surface which reflects part of the display in such a manner as to provide an appearance of a single monolithic structure erected just for the purpose of the particular display and to divert the eye from noticing that the individual bays are formed from separable replaceable elements.

The utilization of the individual bays along the single wall provides a separation of types of merchandise while nevertheless leaving the entire display open to view and provides for a more pleasing arrangement of the merchandise in each particular bay so that it will be more readily acceptable to the consumer.

Thus, the primary object of the invention is the provision of a display device for a longitudinal wall or partition in which a single header extending along the longitudinal wall or partition cooperates with a plurality of angularly arranged elements, each of which forms a triangle with a portion of the wall to provide a series of bays which will permit apparent separation of the various displays while nevertheless permitting the entire series of displays on a wall unit to be viewed simultaneously.

A further object of the present invention is the arrangement of the individual angularly arranged panels so that they are hinged together and therefore may be shipped and stored in collapsed form but may be erected to a predetermined angular position and maintained at such position by a spreader so that a top bracket or header provided for each panel can be merged in and become an apparent part of a main bracket or header along the wall, thereby creating a sense of continuity and unity of structure in the entire unit.

As a further object of the present invention, means are provided for concealing or otherwise masking the seams between the triangularly arranged panels and the back wall of the display by utilizing, for instance, a longitudinal mirror along the seam so that the mirror will provide reflection of the merchandise and enhancement of the display while at the same time concealing the fact that the display is arranged from a series of separate panels.

BRIEF DESCRIPTION OF THE DRAWINGS

The foregoing and many other objects of the present invention will become apparent from the following description and drawings in which.

DETAILED DESCRIPTION OF THE PREFERRED EMBODIMENT

Figure 1:
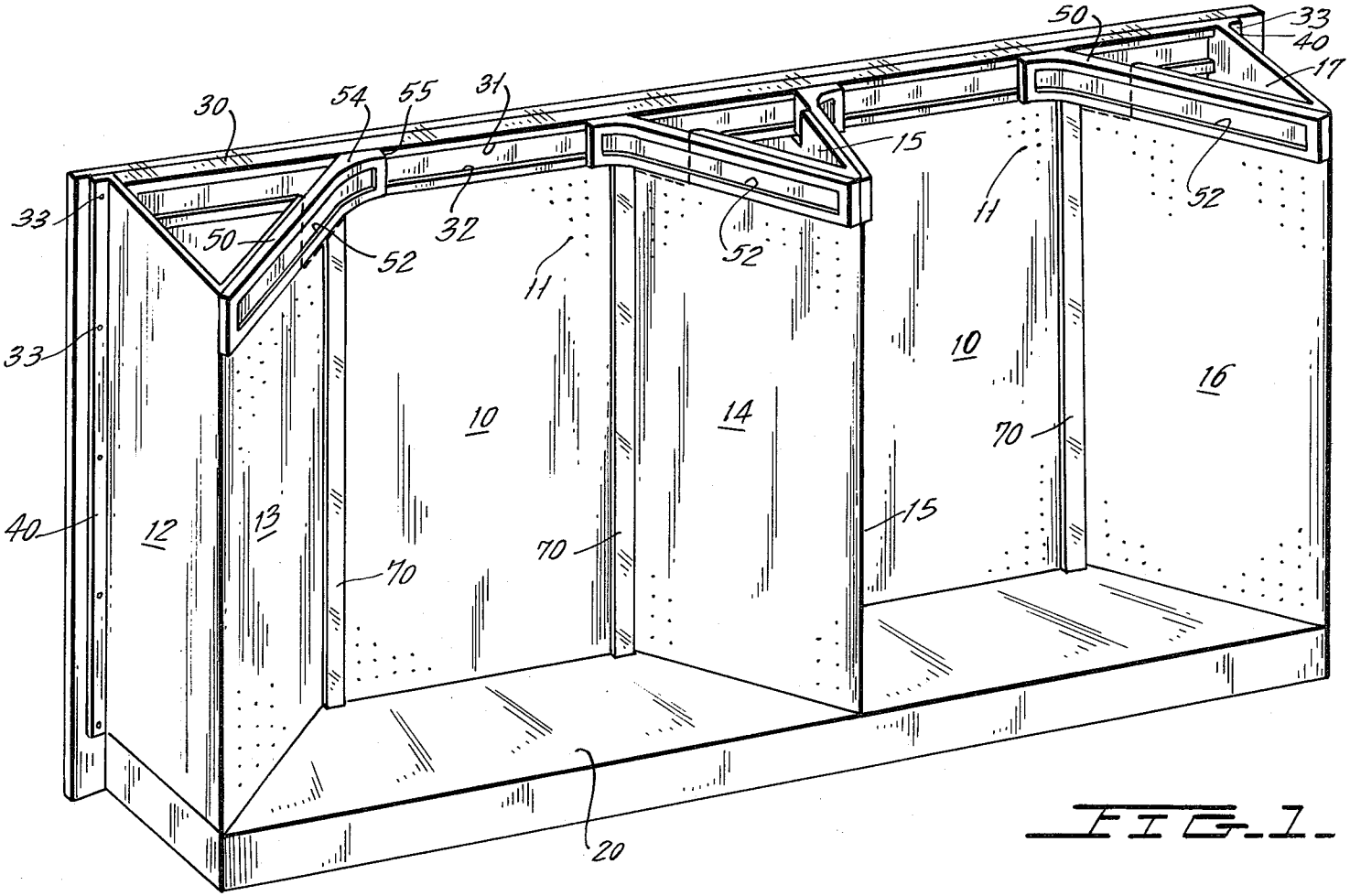
FIG. 1 is a perspective view of a display constructed in accordance with the principles of the present invention.
Figure 2:
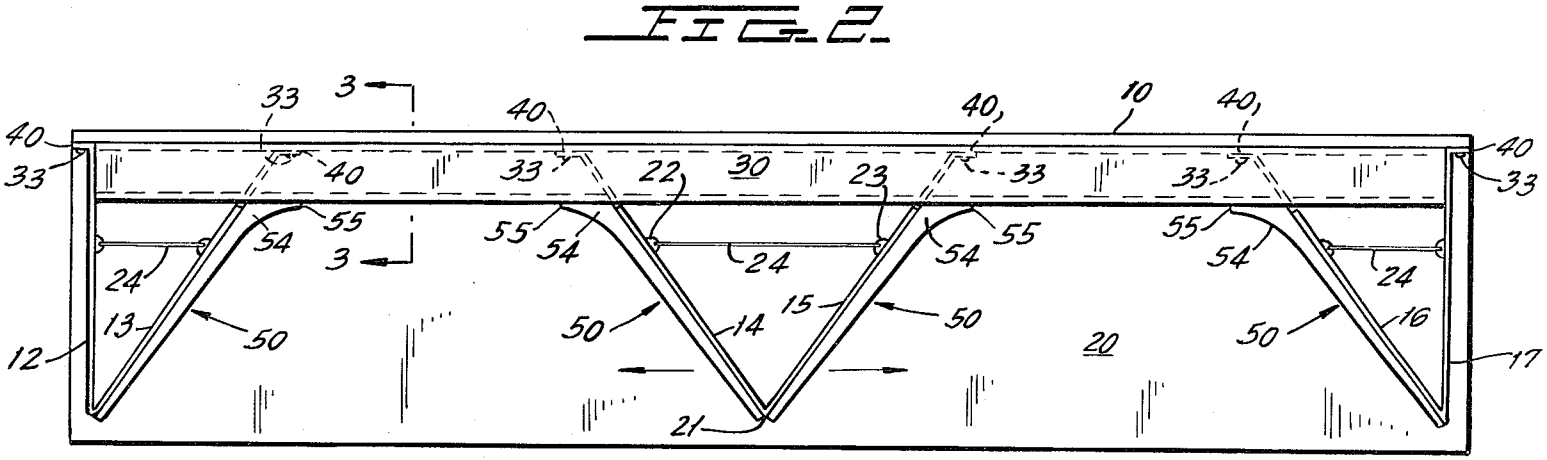
FIG. 2 is a top plan view of the display of FIG. 1.

Referring first to FIGS. 1 and 2, the back or principal display wall 10 is provided with a pegboard surface 11 for the mounting of items to be displayed. However, as previously pointed out, the utilization of a single long wall may lead to a cluttered appearance or at least an apparent disorganized arrangement which is not conducive to attracting customers or to sales. Hence, the present invention is specifically directed to the creation of bays which will serve to divide or break up the long wall so that the articles to be displayed may be organized by category of merchandise, trade name or otherwise. These bays provide additional display room and at the same time permit an overall view of the entire display which makes it possible for a customer to go directly to the particular section of the display desired.

In order to accomplish this result, a plurality of angularly arranged panels 12–13, 14–15, 16–17 are provided. In the particular embodiment illustrated in FIGS. 1 and 2 only three pairs of panels are shown, creating two bays. Additional sets of panels can be used limited only by the length of the principal display wall 10 and the spacing desired between adjacent panels. While the adjacent panels are shown equally spaced, they may be spaced at different intervals individual to each bay.

It should be noted that dimensionally the panels may extend vertically to any height desired, although the panels and the principal display wall 10 should be no higher than can be reached comfortably by the average customer. The individual panels 12–17 may be of the order of only 18 inches long horizontally so that when arranged angularly, the depth of the display and the depth of each bay is such that the principal display wall 10 may readily be reached by the customer. Also, the depth of the bays is preferably chosen such that a customer standing at a normal distance from the display can get a bird's eye view of all of the bays so that while the display is organized and controlled, it is still available to view over its entire length.

A platform 20 serves as the base support for the display. Platform 20 need not be weight bearing since the depth of the display is such that any customer may readily reach the display without stepping on the platform, although if desired, an appropriate plank or stud may be used under the forward end of the platform to prevent its collapse.

The panels as, for instance, panel 14–15 are hingedly connected to each other along the hinge line 21 and are unfolded to the desired extent to match the header sections as hereinafter described. The panels 14–15 as shown particularly in FIG. 2 are provided with vertically apertured studs 22, 23 adapted to receive the downwardly depending legs (not shown) of a preferably rigid spreader member 24 which maintains the panels 14–15 in a predetermined orientation with respect to one another.

Individual pairs of panels 12–13, 14–15, 16–17 are also preferably pegboard type panels with a plurality of openings therein to receive merchandise supporting elements. Each of the angled panels, such as 14–15, is provided with a subsidiary header 50 which may be individually secured to each of the panels 14, 15.

Figure 3:
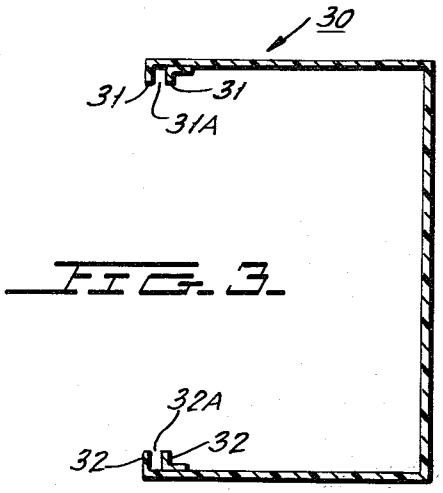
FIG. 3 is a cross-sectional view taken on line 3—3 of FIG. 2, looking in the direction of the arrows, of the principal header structure of the present invention, the header being mounted on the wall to which the additional angular members are secured.

The principal display wall 10 is provided with a longitudinal principal header 30. As shown particularly in FIGS. 1, 2 and 3, the principal header 30 is a recessed member which may be supported in suitable position on the principal display wall 10 by appropriate screws or otherwise and may be made a permanent art of the display.

The individual pairs of panels such as 14–15 are then unfolded and installed with their free edges against the principal display wall 10. As will be noted from FIGS. 1, 2 and 3, the principal header 30 is a channel of rectangular cross-section running the length of the wall 10 and is provided with guide rails 31 at the top and 32 at the bottom thus forming narrow grooves 31A and 32A for receiving placards or other devices which may provide appropriate information to the customer regarding the type of merchandise being sold (e.g. cosmetics). Since the principal header 30 extends across the entire length of the display wall 10 and since the panels 12–13, 14–15 and 16–17 may be moved, it is preferable that the information on the placards received by header 30 be general to all bays. Information specific to any given bay may be provided on subsidiary headers 50 in the manner described below.

The panels 12–13 at one end and 16–17 at the other end have been shown unfolded only partially thus serving as end panels. An appropriate spreader (which is shorter than the spreader located between panels 14, 15) may be utilized but this is not necessary, since panels 12 and 17 are secured to the back wall in any suitable manner as by the screws 33. They may also be secured to the principal display wall 10 by appropriate pegs inserted through the flange members 40 (FIG. 2), on the end panels 12 and 17. Such flange members 40 are present on each of the panels 12–13, 14–15 and 16–17 and may as already mentioned permit the panels to be secured in position either by screws entering the principal display wall 10 by pegs which pass through matching holes in the flanges 40 and appropriate openings in the back wall 10 or by any other suitable means.

Each of the panels 13–14, 15–16 may be provided with an individual subsidiary header 50. As shown in FIGS. 4, 5, 6 and 7, headers 50 have appropriate recesses 52 for receiving a placard or other device which will provide information to the consumer. Unlike the placards received in principal header 30, these placards can contain information relating to the particular bay with which they are associated.

One of the basic elements of the present invention resides in the fact that the individual subsidiary headers 50 blend in with the principal header 30 and appear to be a continuation thereof. For this purpose, the subsidiary headers 50, which are secured to the tops of the panels 13–14, 15–16, are curved at region 54 as close as possible to a vanishing point at 55, within the limits of appropriate trouble-free construction, so that when secured in position they blend in with the principal header 30 and appear to be a continuation thereof. The subsidiary headers 50 are preferably of light plastic construction and are secured at the tops of the panels 13–14, 15–16 by connectors 51 which include a molded base support and a peg extension extending therefrom. The peg projections 61 fit into appropriate pegboard openings adjacent the top of each of the panels, thereby holding the subsidiary header 50 in place.

Figure 5:
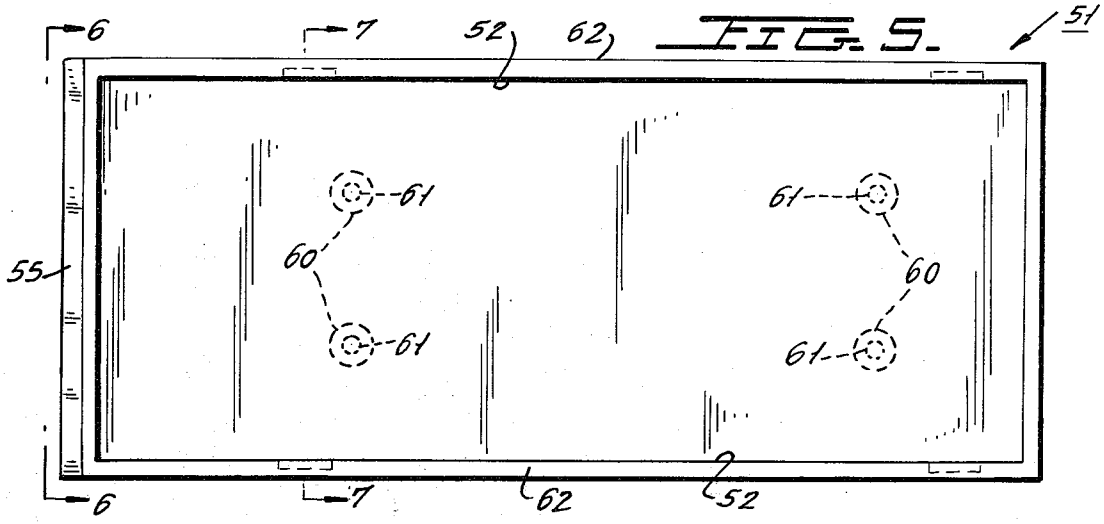
FIG. 5 is a front elevation of the subsidiary header member of FIG. 4 and thus one of the subsidiary header members of FIGS. 1 and 2.
Figures 4, 6, 7:
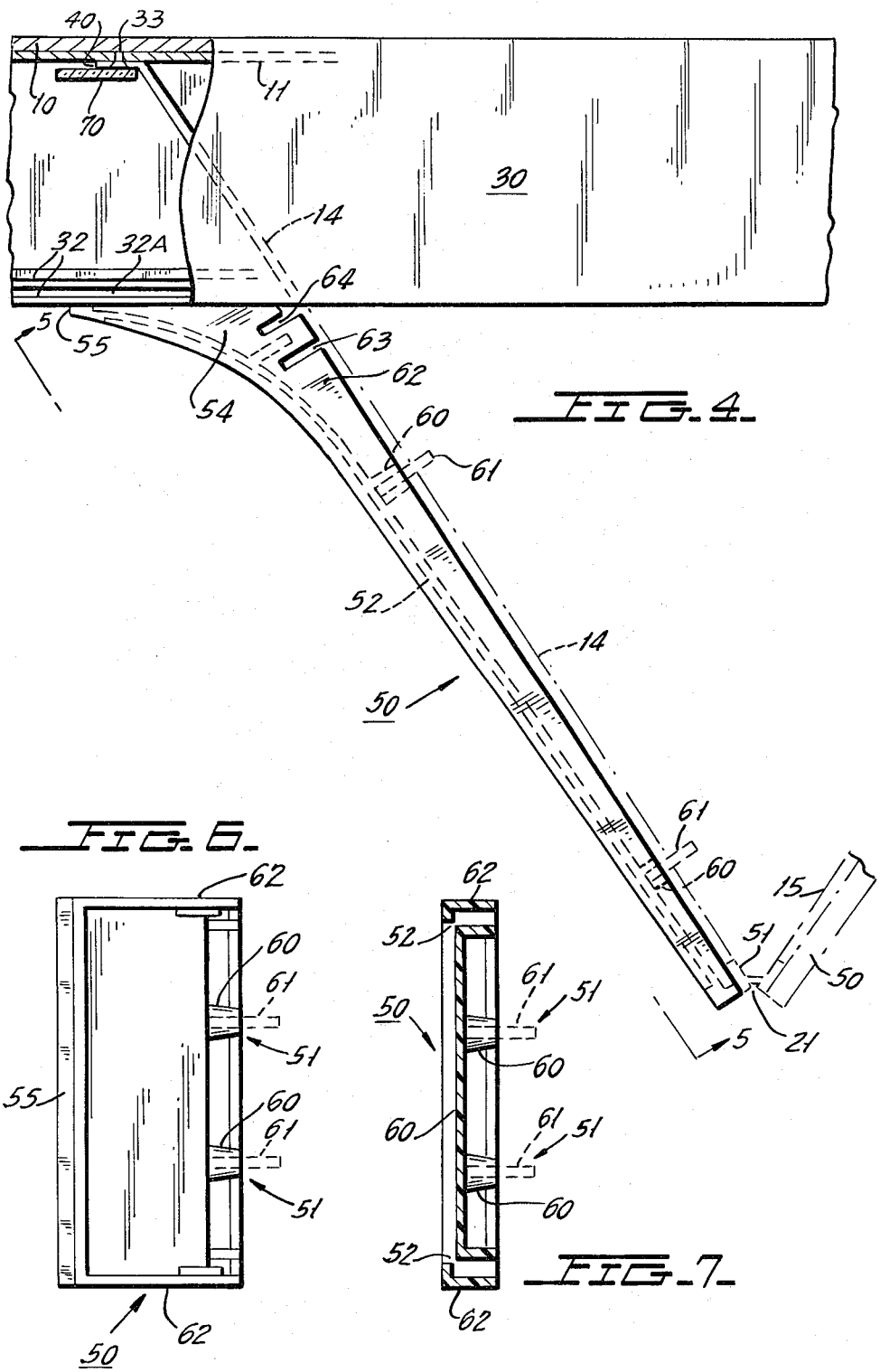
FIG. 4 is a partially cut away top view of the angular members secured in position against the principal wall and with respect to the principal header showing the interrelated structures of the principal header and the subsidiary headers.
FIG. 6 is a cross-sectional view taken on line 6—6 of FIG. 5, looking in the direction of the arrows, and showing an end view of the subsidiary header.
FIG. 7 is a cross-sectional view of the subsidiary header of FIGS. 4 and 5 taken on line 7—7 of FIG. 5 looking in the direction of the arrows.

The subsidiary headers 50 are of substantially rectangular cross-sectional construction, as shown in FIGS. 5, 6 and 7, so that they will not only receive an appropriate placard or other card, but will appear to be a continuation of the principal header 30. Flanges 62 which form the top and bottom of the subsidiary headers 50 may, if desired, be slit at 63–64 so that when placed in position, subsidary headers 50 may more readily be bent to the desired curvature being held in that desired curvature by the engagement of, for example, subsidiary header 50 with the panel 14 as seen in FIG. 4, so that if there is any slight misalignment in curvature, that misalignment will be covered up.

As pointed out above, and as seen also particularly in FIG. 4, each of the flanges 40 is used to connect each of the panels to the principal display wall 10. When the subsidiary headers 50 are secured in position, the curvature at region 54 and the narrowing of the structure at 55 causes the apparent blending to occur. While the display may be finished off in any desired manner, the display itself may be completed as shown by the panels 12–13 and 16–17 at each end where the panels 12 and 17 may become the end pieces, matching the depth of the platform 20. It is obvious that any number of folding panels may be used between the end panels depending on the length of the display, the number of separate bays desired and the desired length of each bay.

The utilization of screws 33 or other visible fasteners to secure the panels to principal display wall 10 by means of flanges 40 may tend to defeat the apparent unity of the entire structure unless the fasteners themselves are concealed. An ornamental covering 70, which may be a mirror, may therefore be placed along each of the seams between the angularly placed panels and the principal display wall, and serves to cover up the seam and at the same time provides a reflection which sets up multiple views of the contents of the bay or recess. Such mirrors may be placed in position in any desired way as by clamps or adhesive.

As shown in FIG. 4, the hinge 51 located between adjacent panels may be of unitary molded plastic construction and may be attached to the panels in any known manner. The subsidiary headers 50 may be interconnected in the same manner as adjacent panels although they may retain free of each other being held in position by the connectors 51. The utilization of an interconnection at the apex of the two subsidiary headers 50 is desirable however to prevent a gap and to provide a finished appearance thereat.

In the embodiment of the invention described above, a multi-bin display is an independent unit which may either stand alone or be placed against the wall of the building. If desied, the platform 20, pairs of panels 12–13, 14–15 and 16–17, principal header 30, subsidiary headers 50 and mirrored strips 70 can be sold as individual elements of a kit which may be attached to any stationary wall support which may be permanently located in a store area. In such a case, the foregoing elements would be connected to the stationary wall to form a display looking substantially similar to the display illustrated in FIG. 1. Additionally, the entire display unit of FIG. 1 can be sold as a kit in which the foregoing elements are all attached to a principal display wall 10 included in the kit.

In the foregoing, the present invention has been described in connection with preferred illustrative embodiments thereof. Since many variations and modifications of the present invention will now be apparent to those skilled in the art, it is preferred that the scope of this invention be determined not by the specific disclosures herein contained but only by the appended claims.

What is claimed is:

1. An adjustable display unit comprising:

a principal display wall;

a principal header for said principal display wall protruding therefrom and extending longitudinally thereof, said principal header adapted to provide a support for placards or other information bearing devices, said header extending substantially the entire length of said principal display wall;

a plurality of pairs of panels, each panel of said pair of panels being hingedly connected to the other panel in said pair;

means for mounting each said pair of panels to said principal display wall at any of a number of possible locations along said principal display wall so as to create individual display bays of desired sizes, with each of said pair of panels forming a triangle with a respective portion of said principal display wall; and a plurality of subsidiary headers each attached to a respective one of said panels, each of said subsidiary headers extending from the front of its respective panel to said principal header, each of said subsidiary headers being curved to give the appearance of merging into said principal display header, each of said subsidiary headers being movable, with the panel to which it is attached, with respect to said principal header so that each said subsidiary header appears to merge with that portion of said principal header which it is located adjacent to and said adjustable display unit gives the appearance of a single continuous display unit.

2. The adjustable display unit of claim 1, wherein said plurality of pairs of panels comprises at least three pairs of panels.

3. The adjustable display unit of claim 1, wherein adjacent pairs of panels form respective bays on said principal display wall so as to provide increased areas for the display of merchandise and a separation of groups of merchandise.

4. The adjustable display unit of claim 3, wherein said display unit further comprises an ornamental covering which covers said means for mounting.

5. The adjustable display unit of claim 4, wherein said ornamental covering is a mirrored reflector extending over substantially the entire height of said principal display wall in the area where said panels and said principal display wall meet.

6. The adjustable display unit of claim 5, wherein said display unit includes at least three pairs of panels, first and second pairs of panels being located at first and second opposite ends of said principal display wall, the remaining said pairs of panels being located intermediate said first and second pairs of panels, each panel of said intermediate pairs of panels being oblique to said principal display wall, that panel of said first and second pairs of panels which is located closest to first and second ends of said principal display wall, respectively, being perpendicular to said principal display wall, the remaining panel of said first and second pairs of panels being oblique to said principal display wall.

7. The adjustable display unit of any one of claims 1, 2, 4, 5 or 6 in which the height of said principal header and said subsidiary headers are the same and the top of said principal header and said subsidiary headers lie in the same plane.

8. A kit for an adjustable display unit, comprising:

a principal header adapted to be mounted on a principal display wall so as to protrude therefrom and extend longitudinally thereof, said principal header adapted to provide support for placards or other information bearing devices, said principal header extending substantially the entire length of said principal display wall, a plurality of pairs of panels, each panel of said pairs of panels being hingedly connected to the other panel in said pair;

means for mounting each said pair of panels to said principal display wall at any of a number of possible locations along said principal display wall so as to create individual display bays of desired sizes, with each of said pair of panels forming a triangle with a respective portion of said principal display wall;

a plurality of subsidiary headers, each adapted to be connected to a different said panel, each said subsidiary header being curved to give the appearance of merging into said principal header when said kit is assembled to form a display, each of said subsidiary headers being movable, with the panel to which it is attached, with respect to said principal header so that each said subsidiary header appears to merge with that portion of said principal header which it is located adjacent to and said adjustable display unit gives the appearance of a single continuous display unit when said kit is assembled together.

9. The kit of claim 8, wherein said plurality of pairs of panels comprises at least three pairs of panels.

10. The kit of claim 8, wherein said panels have flanges which enable said panels to be mounted to said wall.

11. The kit of claim 10, further comprising ornamental coverings adapted to cover said flanges.

12. The kit of claim 11, in which said ornamental coverings have a mirrored surface which is exposed when said kit is assembled.

* * * * *